United States Patent [19]

Hubert et al.

[11] 4,249,666

[45] Feb. 10, 1981

[54] HOLLOW BODY OF THERMOPLASTIC MATERIAL

[75] Inventors: Guy Hubert, Lasne-Chapelle-Saint-Lambert; Roger Dechenne, Strombeek Bever, both of Belgium

[73] Assignee: Solvay & Cie, Brussels, Belgium

[21] Appl. No.: 883,032

[22] Filed: Mar. 2, 1978

[30] Foreign Application Priority Data

Mar. 2, 1977 [FR] France ..... 77 06680

[51] Int. Cl.[3] ..... B65D 6/38; B65D 8/12

[52] U.S. Cl. ..... 215/1 C; 220/70

[58] Field of Search ..... 215/1 C; 220/66, 70; D9/216, 218

[56] References Cited

U.S. PATENT DOCUMENTS

| | | | |
|---|---|---|---|
| 91,754 | 6/1869 | Lawrence | 220/70 |
| 163,747 | 5/1875 | Cummings | 220/70 |
| 3,237,910 | 3/1966 | Lavedas | 220/66 |
| 3,400,853 | 9/1968 | Jacobsen | 220/66 |
| 3,409,167 | 11/1968 | Blanchard | 220/66 |
| 3,482,724 | 12/1969 | Heaton | 215/1 C |
| 3,814,279 | 6/1974 | Ravzal | 220/66 |
| 3,870,181 | 3/1975 | Sincock | 215/1 C |
| 4,010,867 | 3/1977 | Jones | 220/70 |

FOREIGN PATENT DOCUMENTS

| | | | |
|---|---|---|---|
| 100183 | 2/1937 | Australia | 220/66 |
| 698548 | 11/1964 | Canada | 220/66 |
| 1061643 | 7/1959 | Fed. Rep. of Germany | 220/66 |
| 1385421 | 12/1965 | France | 220/66 |
| 2308554 | 11/1976 | France | 220/70 |

*Primary Examiner*—Allan N. Shoap

*Attorney, Agent, or Firm*—Spencer & Kaye

[57] ABSTRACT

A hollow container made of thermoplastic material, having its base connected to its side wall by an integral, peripheral rounded molding, and having its base formed of at least two substantially planar, axially staggered, concentric annular zones connected together by alternating molded portions of rounded cross section.

7 Claims, 2 Drawing Figures

HOLLOW BODY OF THERMOPLASTIC MATERIAL

BACKGROUND OF THE INVENTION

The present invention relates to a hollow body made of a thermoplastic material, the body being of generally cylindrical shape and having a closed base which is recessed and is connected to the side of the body by a peripheral annular molding, examples of such bodies being bottles or similar containers.

Currently, increasingly frequent use is made of thermoplastics for the production of hollow bodies such as bottles for packaging liquids.

In order to increase the stability of these hollow bodies when they are placed in a vertical position, or upright, it is known to provide them with a recessed, or reentrant, base because this type of base has good resistance to deformation, especially under the effects of internal pressure.

Hollow bodies which are provided with a recessed base, however, have an impact strength which frequently leaves something to be desired, especially near their base. Consequently, their bases are frequently damaged if the bodies are dropped accidentally, even from a low height.

SUMMARY OF THE INVENTION

It is an object of the present invention to improve the impact strength of such bodies, particularly in the region of their base.

The invention is based on applicants' discovery, arrived at after numerous experiments, of a novel configuration for the base of such hollow bodies made from a thermoplastic, which configuration makes it possible, at one and the same time, to achieve good resistance to deformation and good impact strength.

Furthermore, this particular shape permits easy molding of the hollow bodies by the usual techniques of blow molding, due to the fact that it does not necessitate resorting to special molds equipped with movable bases in order to permit mold release.

Hence, the objects of the present invention are achieved, in a hollow body made from a thermoplastic material and having a generally cylindrical shape and a reentrant, or recessed, base connected to the side wall of the body by a peripheral annular molding, by constituting the base of at least two substantially plane, staggered concentric annular zones connected to one another by alternating molded portions of rounded cross section.

The base of the hollow body according to the invention thus presents, in cross section, a profile in the general shape of a staircase, of which the edges are rounded. The various staggered concentric annular zones are located progressively further away from the support surface of the base of the hollow body as the distance from the periphery increases, i.e. as the distance from the center of the recessed base decreases. Two successive plane zones are connected together by two adjacent molded portions of respectively opposite directions of curvature, such that the cross-section formed by the two molded portions has the form of an S.

According to a preferred embodiment, the hollow body according to the invention is produced in accordance with one of the well-known molding techniques which result in the production of molecularly oriented hollow bodies made from a thermoplastic material. Applicants have in fact found that on applying these techniques, not only is the resulting hollow body produced oriented in its side wall zone, but because of its particular shape the base exhibits a remarkably high degree of molecular orientation. This contributes to an improvement in the mechanical properties to the point that the hollow body can be used for the packaging of carbonated drinks under pressure and even more suitably for non-carbonated liquids. Accordingly, applicants prefer that the hollow body according to the invention exhibit a molecularly oriented side wall and a molecularly oriented base.

The hollow body according to the invention has a side wall of generally cylindrical shape. However, the side need not necessarily be perfectly symmetrical about its axis. It is possible for the shape to depart from that of a perfect cylinder. Thus, the side can have an elliptical or polygonal cross section. In this case, it is preferred that the larger dimension of the cross sections at right angles to the axis of the hollow body should not exceed twice the smaller dimension. Furthermore, the annular zones of the base can have a shape which is not perfectly circular but which does not depart excessively from that of a circle. They can thus be elliptical or polygonal and can be of a shape identical to or different from that of the cross section of the side. It is also preferred that the larger dimension of each zone not exceed twice the smaller dimension.

The widths of the various staggered concentric annular zones can be identical. However, it is preferred that these widths be different, and in particular that these widths increase as a direct function of the distance from the center of the base.

It is additionally preferred that the width of these staggered concentric annular zones be between 1% and 15%, and preferably between 3% and 10% of the maximum radius of the side of the hollow article.

According to a first embodiment of the invention, the staggered concentric annular zones can be positioned in planes perpendicular to the longitudinal axis of the hollow body.

According to a second embodiment, which is preferred by applicants, these staggered concentric annular zones are inclined relative to the longitudinal axis of the hollow body so that when the latter is standing upright on its base, the interior edge of each annular zone is located at a higher level that its exterior edge. A hollow body of this type can in fact be produced by blow molding in a conventional mold consisting of the combination of two separable mold halves and can easily be removed from the open mold without it being necessary to resort to any artifices such as, for example, movable base portions of the mold, because of the fact that no part of the hollow body is undercut.

If the staggered concentric annular zones are inclined relative to the longitudinal axis of the hollow body, applicants prefer that these zones form an angle of between 1° and 15°, and preferably between 3° and 10°, with a plane perpendicular to the longitudinal axis of the hollow body. The angles of inclination of the various staggered concentric annular zones can be identical to or different from, one another.

The base of the hollow body according to the invention has a central part connected to the innermost annular zone, the shape of which central part is optional and may, for example, be plane. However, the applicants prefer that this central part have the shape of a spherical dome pointing toward the exterior of the hollow body, i.e. which is downwardly convex. This central part can easily be connected to the innermost annular zone by a molded portion, or by two molded portions having alternating directions of curvature, the or each molded portion being of rounded cross section.

The adjacent molded portions which provide the connection between two successive, axially staggered concentric annular zones are preferably so produced that the hollow body has a base free from undercut parts which are prone to interfere with the release of the hollow body from the mold. Furthermore, these portions preferably provide a connection which is free of sharp angles between the staggered concentric annular zones. Preferably, these alternating molded portions have circular cross sections the radii of which are between 5% and 30% of the maximum radius of the side of the hollow article. These radii may be identical for all the molded portions, or may be different.

The number of staggered concentric annular zones can vary and is chosen in accordance with the diameter of the base. In general, applicants prefer this number to vary between 3 and 8.

In general, applicants prefer that the maximum height of the recessed base of the hollow body according to the invention not exceed 15% of the maximum radius of the side of the hollow article. When the hollow body according to the invention is in a vertical position, it rests on the peripheral annular molding which connects the side of the body to the recessed base.

The hollow body according to the invention can be produced from any thermoplastic and preferably from a thermoplastic which can be molecularly oriented. By way of non-limiting examples of the latter, there may be mentioned the resins based on vinyl chloride, the polymers and the copolymers produced from alpha-olefines containing up to eight carbon atoms in their molecule, the acrylic polymers and copolymers and especially those produced from acrylonitrile, the polyesters such as poly(ethylene glycol terephthalate), and the polycarbonates.

DESCRIPTION OF THE PREFERRED EMBODIMENTS

Figure 1:
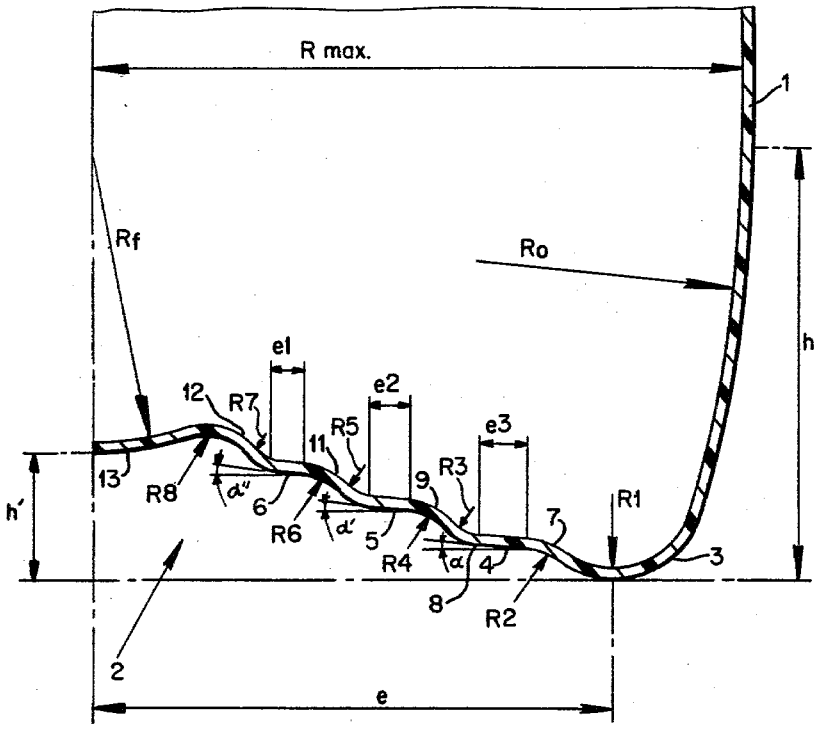
FIG. 1 is a cross-sectional view of one-half of the base portion of a preferred embodiment of a hollow body according to the invention.

As can be seen in FIG. 1, the hollow article is composed of a side wall 1 of generally cylindrical shape and a recessed, or reentrant, base 2 connected to the side wall by a peripheral annular molding 3.

The recessed base possesses three substantially planar, axially staggered, concentric annular zones 4, 5 and 6 connected to one another by molded, or shaped portions 7 to 12, all of rounded cross secton and of alternating directions of curvature.

In the embodiment illustrated in FIG. 1, the annular zones are slightly inclined to planes perpendicular to the axis of the body and they have respectively different widths which vary from one zone to the next as a direct function of their distance from the center of the base.

Finally, the base has a central part 13 in the form of a downwardly convex dome of spherical section.

Figure 2:
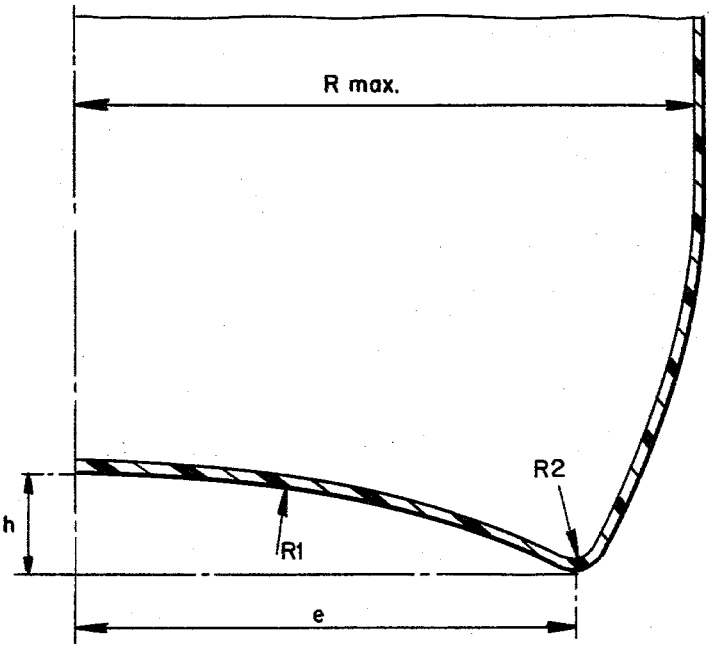
FIG. 2 is a view similar to that of FIG. 1 of a corresponding portion of a hollow body having a conventional base.

In order better to show the advantages offered by the hollow body according to the invention, two series of oriented bottles each having a capacity of 1,500 cc were produced, one series of bottles being provided with a base according to FIG. 1 and the other series having a conventional recessed base in the form shown in FIG. 2.

The thermoplastic employed is rigid polyvinyl chloride. The working conditions, in particular the parameters determining the resulting molecular orientation, are the same for both series of bottles.

The principal dimensions of the bottles produced in accordance with the two figures are given below:

| | |
|---|---|
| FIG. 1 | |
| R max:44.4 mm | $e_1$:1.6 mm |
| $R_o$:100 mm | $e_2$:2.4 mm |
| $R_1$:6 mm | $e_3$:3.2 mm |
| $R_2$ to $R_8$:3 mm | h:38 mm |
| $R_f$:20 mm | h':5 mm |
| $\alpha = \alpha' = \alpha'' = 5°$ | e:70.4 mm |
| FIG. 2 | |
| R max:44.4 mm | |
| $R_1$:80.6 mm | |
| $R_2$:4 mm | |
| h:5 mm | |
| e:35 mm | |

The series of bottles thus obtained are then filled and sealed and subjected, at 15° C., to impact strength tests, the results of which are recorded in Table I below.

TABLE 1

| Test | Base according to FIG. 1 | Base according to FIG. 2 |
|---|---|---|
| Vertical drop from a height of 0.7 m onto an inclined base with inclination to the horizontal of: | | |
| 5° | 5 | 80 |
| 10° | 25 | 100 |
| Sideways drop onto a horizontal base | | |
| drop height:0.70 m | 0 | 60 |
| :1.10 m | 29 | 100 |

The numbers shown for the various experiments give the percentages of bottles broken during the particular test.

It will be seen immediately that hollow bodies according to the invention (FIG. 1) exhibit markedly improved impact strength relative to the hollow bodies of conventional shape (FIG. 2).

The hollow bodies according to the invention are particularly suitable for packaging non-carbonated table waters, or mineral waters, and carbonated drinks such as beer and soft drinks. Furthermore, due to the presence of the substantially planar staggered concentric annular zones, the base of a hollow body according to the invention can easily be provided with engraved inscriptions.

It will be understood that the above description of the present invention is susceptible to various modifications, changes and adaptations, and the same are intended to be comprehended within the meaning and range of equivalents of the appended claims.

What is claimed is:

1. In a molded, molecularly oriented hollow body of thermoplastic material including a side wall of generally cylindrical shape, a reentrant base, and a peripheral annular support radially connecting the lower end of the side wall to the outer edge of the base, the improvement wherein said base comprises more than two substantially planar, axially staggered, concentric annular zones of respectively different widths, which widths increase progressively in the direction from the center of said base, each said concentric annular zone being inclined relative to the longitudinal axis of said hollow body such that when said body is standing upright on its base, the interior edge of each said annular zone is located at a higher level than the exterior edge thereof, connecting portions of rounded cross section connecting adjacent annular zones together, a central part in the form of a spherical dome pointing towards the exterior of said hollow body, and a further connecting portion of rounded cross section which connects said central part to the adjacent annular zone, whereby the base region of said body has an enhanced impact strength.

2. An article as defined in claim 1 wherein the width of each said concentric annular zone is between 1% and 15% of the maximum radius of said side wall of said hollow body.

3. An article as defined in claim 1 wherein each said concentric annular zone forms an angle of between 1° and 15° with a plane perpendicular to the longitudinal axis of said hollow body.

4. An article as defined in claim 1 wherein each connecting portion between two adjacent annular zones includes two surface parts having respectively opposite directions of curvature.

5. An article as defined in claim 4 wherein each said connecting portion is of circular cross section and has a radius of curvature which is between 5% and 30% of the maximum radius of said side wall of said hollow body.

6. An article as defined in claim 1 wherein said base has between 3 and 8 of said concentric annular zones.

7. An article as defined in claim 1 wherein the total height of said reentrant base is at most equal to 15% of the maximum radius of said side wall of said hollow body.

* * * * *